US005984050A

United States Patent [19]

Ronald

[11] Patent Number: 5,984,050

[45] Date of Patent: Nov. 16, 1999

[54] CARRIAGE SUSPENSION FOR LIFT TRUCK

[75] Inventor: David A. Ronald, Windsor, N.Y.

[73] Assignee: The Raymond Corporation, N.Y.

[21] Appl. No.: 08/865,040

[22] Filed: May 29, 1997

[51] Int. Cl.[6] ..... B66F 9/06

[52] U.S. Cl. ..... 187/226; 187/234

[58] Field of Search ..... 187/226, 222, 187/233, 234, 230; 414/628, 631

[56] References Cited

U.S. PATENT DOCUMENTS

| | | | |
|---|---|---|---|
| Re. 29,123 | 1/1977 | Malm et al. | 296/35 R |
| 1,640,326 | 8/1927 | Jonasson et al. | 187/9 R |
| 2,910,204 | 10/1959 | Wight | 214/730 |
| 3,172,500 | 3/1965 | Dolphin et al. | 187/9 |
| 3,280,401 | 10/1966 | Cook et al. | 318/258 |
| 3,282,374 | 11/1966 | Allen et al. | 182/12 |
| 3,376,990 | 4/1968 | Latall | 214/671 |
| 3,507,350 | 4/1970 | Boyajian | 180/101 |
| 3,531,069 | 9/1970 | Dubberley | 248/15 |
| 3,574,383 | 4/1971 | Frater | 294/67 |
| 3,741,346 | 6/1973 | Herdemann | 187/9 |
| 3,756,350 | 9/1973 | Gandolfo et al. | 187/9 |
| 3,774,711 | 11/1973 | Lacey | 180/77 R |
| 3,907,141 | 9/1975 | Ahrendt et al. | 214/701 P |
| 3,937,346 | 2/1976 | van der Laan | 214/730 |
| 3,940,177 | 2/1976 | Miers et al. | 296/35 R |
| 3,949,892 | 4/1976 | Ohms | 214/674 |
| 3,972,388 | 8/1976 | McVeen . | |
| 4,476,960 | 10/1984 | Yarris | 187/226 |
| 4,485,894 | 12/1984 | Soule et al. | 187/9 E |
| 4,502,673 | 3/1985 | Clark | 267/64.24 |
| 4,503,935 | 3/1985 | Haffer et al. | 187/9 E |
| 4,526,251 | 7/1985 | Johannson | 187/9 R |
| 4,575,976 | 3/1986 | McDermott et al. | 52/118 |
| 4,692,086 | 9/1987 | Morita et al. | 414/635 |
| 4,989,684 | 2/1991 | Conaway | 180/89.15 |
| 5,067,592 | 11/1991 | Miskin et al. | 187/9 R |
| 5,109,939 | 5/1992 | Conaway et al. | 180/89.15 |
| 5,116,188 | 5/1992 | Kurohashi et al. | 414/719 |
| 5,253,853 | 10/1993 | Conaway | 267/256 |
| 5,579,859 | 12/1996 | Quelhorst et al. | 180/89.13 |
| 5,641,041 | 6/1997 | Masuda et al. | 187/347 |
| 5,657,834 | 8/1997 | Plangher | 187/226 |

FOREIGN PATENT DOCUMENTS

| | | |
|---|---|---|
| 3017456 | 11/1981 | European Pat. Off. . |
| 19528050 | 2/1996 | European Pat. Off. . |
| 08225111 | 3/1996 | Japan . |

*Primary Examiner*—Kenneth W. Noland
*Attorney, Agent, or Firm*—Quarles & Brady, LLP

[57] ABSTRACT

A carriage suspension system for use with a lift truck having a tractor, a mast including a vertical track and a carriage suspended from the track for movement therealong. The carriage is raised and lowered via chains, one end of each chain being secured via a compressible spring which isolates the carriage from tractor vibrations and oscillations. The track restricts lateral carriage movement.

32 Claims, 5 Drawing Sheets

CARRIAGE SUSPENSION FOR LIFT TRUCK

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to lift trucks generally and more specifically to a suspension system which isolates a vertically raisable lift carriage from other truck components.

Most lift trucks include a lift carriage mounted to a mast which is in turn mounted to a tractor. The tractor includes a plurality of wheels which facilitate horizontal truck movement within the factory, warehouse, or the like. The mast includes a mainframe attached to the tractor and may include one or more telescopics. Generally, trucks that service shelves at greater heights will use one, two and sometime three telescopics to extend the maximum elevated fork height without substantially increasing the fully lowered height of the truck. In all cases, the carriage is mounted to the innermost telescopic. The mast also includes one or more ram/chain mechanisms which facilitate vertical movement of the carriage. Typically the carriage will be mounted to the track of the mainframe or telescopic for movement therealong. The lower end of the ram will be mounted in a fixed position to the mainframe or telescopic. The ram includes a pulley mechanism at its upper end. A chain connected at a first end to an anchor which is fixed in a single position with respect to the mainframe or telescopic, extends upwardly over the pulley mechanism and is connected to the carriage at a second end. To raise the carriage with the load, the ram is extended. Because the first end of the chain is fixed, when the ram is extended, the chain's second end is raised, lifting the carriage.

If the vehicle contains no telescopics, the carriage will be mounted to the track of the mainframe for movement therealong and the base of the ram will be mounted to the mainframe. If the vehicle contains a single telescopic, the pulley mechanism described above will also be attached to the telescopic for vertical movement thereof. The carriage will be mounted to the track of the telescopic for movement therealong and the telescopic will be mounted to the track of the mainframe for movement therealong. The base of the ram and the first end of the chain will be fixed to the mainframe. If the vehicle includes two telescopics, the first telescopic is typically raised in a manner similar to the above using one or more additional ram/chain mechanisms.

In this case the ram(s) which elevates the carriage is fixed to the telescopic to which the carriage is mounted.

In all of the above configurations, the dimensions of the components are chosen so that throughout the full range of vertical motion of the carriage, including the fully lowered position, the total carriage weight is suspended by the aforementioned ram/chain mechanism.

In modern lift truck applications it is desirable to elevate to increasingly greater heights. As is well known in the industry, a rigid mast and tractor are desirable to retain stability at the greater heights. Unfortunately, a stiff mast and tractor system can permit the transmission of severe vibrations and oscillations to the carriage. This is because the truck described above does not isolate the carriage from truck vibrations which, in many cases, are magnified as they are transmitted through the truck. This later phenomenon is particularly true where the vibrations are at the same frequency as a natural oscillating frequency of the truck.

One common carriage attachment is a lift fork including two or more horizontal lifting arms. The arms or forks can be slid under a load and raised via the carriage. In this case if the carriage vibrations are sufficient, a load on the forks can shift. A shifted load can at least contribute to a perception of instability which will cause an operator to slow the operation of the truck, thereby reducing the overall productivity.

Another common carriage attachment is an operator's carriage. For this reason, vibrations are often transmitted to the operator's carriage and tend to cause operator discomfort.

Moreover, because the ram/chain mechanism is rigid, the ram/chain components are subjected to extreme stress each time the truck is used which reduces the useful life of the components.

The industry has generally recognized operator discomfort and load carrying problems due to truck vibrations during operation and has attempted to solve these problems in a number of different ways. One solution has been to provide a better wheel suspension system. Unfortunately, better suspension systems can further decrease truck stability. For example, wheel deflections can cause a truck to "rock" laterally. This is particularly problematic when a load is suspended at extended elevated heights or when the truck is operating in a very narrow aisle, which is often the case.

Another solution is described in U.S. Pat. No. 3,574,383 which teaches a leaf spring mounted fork, the fork freely and pivotally suspended from a single central spring section to permit "lateral sway" and "lateral resiliency". Unfortunately, while lateral sway may be important in the environment contemplated by the '383 system (i.e. severely uneven terrain in the lateral dimension where one of more wheels may be independently lifted off the ground and the load is relatively low at all times), in the present case, lateral sway cannot be tolerated. In the warehouse environment where aisles are narrow, tractor wheels are relatively close together and the carriage is often disposed along an upper section of the mast, lateral sway causes lateral truck instability which can result in collisions between the carriage and warehouse fixtures. In addition, the '383 system is relatively complex and there fore would be expensive to manufacture.

Another solution has been to provide foam or rubber floor mats inside an operator's station. This solution, however, can only isolate an operator from high frequency vibrations and, it has been found, can exacerbate transmission of low frequency vibrations. In addition, this solution does not eliminate or reduce vibration transmission to the fork and load.

Yet one other solution has been to mechanically isolate the operator platform floor. Unfortunately, this solution also has a number of shortcomings. Once again, solutions of this type are typically expensive. In addition, to effectively isolate an operator in this manner requires a substantial suspended floor which can result in relative motion between an operator and truck controls. Moreover, even if a suspended floor can be designed which effectively isolates an operator from truck vibrations, such isolation does not eliminate load and fork vibrations.

Therefore, it would be advantageous to have a system for use with a lift truck which isolates a lift carriage from tractor vibrations which is simple to manufacture, inexpensive, stable, and durable.

BRIEF SUMMARY OF THE INVENTION

The present invention addresses the need to reduce or attenuate transmission of truck vibrations to a load and an operator's carriage on an operator aloft type truck so as to improve an operator's comfort and load stability.

To this end, the invention includes an apparatus for isolating a carriage on an lift truck, the truck including a tractor supported by a plurality of wheels, a mast mainframe mounted to the tractor and extending essentially vertically upwardly, and, optionally, one or more telescopics mounted for moveable engagement with the mast mainframe and each other if more than one. The apparatus includes a ram having proximal and distal ends, the ram mounted at its proximal end to the mast mainframe, such mainframe being rigidly attached to the tractor, or to a mast telescopic within which the carriage is mounted for movement therealong. The ram being extendible essentially vertically upwardly such that the height of the distal end is variable, a pulley mounted to the distal end, a first anchor secured to the mast mainframe or telescopic in a fixed position relative to the proximal end, an essentially vertical track, comprising either the mast mainframe or a telescopic, mounted to and extending upwardly from the tractor adjacent the ram, a carriage mounted to the track for essentially vertical movement therealong, a second anchor mounted to the carriage, the first and second anchorers being anchor members, a dampener linked to a first of the anchor members and a strand linked at one end to the dampener, passing over the pulley and linked at a second end to a second of the anchor members, whereby, carriage vertical movement is restrained. Preferably the dampener is a compression spring having a first and second ends and the strand is a chain.

Thus, one object of the invention is to provide a simple and inexpensive carriage isolation assembly to eliminate or substantially reduce carriage vibrations. The spring here is simple and relatively inexpensive when compared with mats, station floor suspensions, and wheel suspensions.

Another object is to provide a system of the above kind which restricts lateral movement of the carriage. The track of the mainframe or telescopic, the ram or other means operate independently or in conjunction with other truck components to impede lateral carriage movement making the invention particularly stable and therefore suitable for use in the lift truck environment.

The spring should be at least partially expanded throughout at least a range of loads. The minimum range of loads is preferably between no load and approximately one-fourth the rated capacity of the truck. Preferably, the range of loads is between no load and at least one half of the rated capacity of the truck.

In keeping with the object of providing an inexpensive suspension system, the spring used with the present invention can be a simple spring chosen to eliminate vibrations where the load is a sub-range of the possible load range. This also allows a spring to be chosen which will eliminate vibrations at specific frequencies. In particular, the sub-range can be light loads as loads near a full load will often provide natural damping.

In one aspect an operator's carriage is mounted as the carriage and a pair of lift forks are mounted to the operator's carriage. In another aspect the assembly further includes a linker connecting the chain to the spring, the first anchor member forms an aperture, the linker passes through the aperture and the compression spring and is connected to the second end such that the spring is at least partially compressed between the linker and the first anchor member.

In a preferred embodiment the first anchor member is the first anchor. Also in a preferred embodiment, the spring is chosen to eliminate the transmission of vibration frequencies between 3 and 8 Hertz. Most preferably the spring is chosen to eliminate the transmission of a vibration frequency of 5 Hertz. Thus, another object of the invention is to eliminate the transmission of vibrations to the carriage which are most troublesome. To this end, after a troublesome frequency has been identified, a spring can be chosen which has a natural frequency which is considerably less than the troublesome frequency so that vibrations at the troublesome frequency are absorbed instead of transmitted.

In another aspect the spring includes first and second compression springs and the first and second springs become completely compressed at different carriage weights with the weight required to completely compress the second spring being greater than the weight required to completely compress the first spring. Preferably, the truck is designed to carry the carriage weight with rated capacity and the weight required to completely compress the second spring is approximately this carriage weight plus the rated capacity. Also, preferably the weight required to completely compress the first spring is essentially the carriage weight plus half the rated capacity.

Thus, another object of the invention is to provide a carriage suspension system of the above kind wherein the system operates to eliminate or reduce vibrations despite carriage load characteristics. To this end, two or more springs or a single spring having different characteristics along different sections of its length can be provided wherein the different springs or spring sections are responsive under different loading conditions. Then while one spring or section might not function under certain loading conditions, another spring or section may function.

The invention also includes a suspension apparatus to be used with a material handling vehicle, the vehicle including a tractor supported by a plurality of wheels, a mast mainframe mounted to the tractor and extending essentially vertically upwardly, and optionally, one or more telescopics mounted for movable engagement with the mast mainframe and each other if more than one. The apparatus includes a ram having proximal and distal ends, the ram mounted at its proximal end to the mast mainframe, such mainframe being rigidly attached to the tractor, or to a telescopic within which the carriage is mounted for movement therealong. The ram being extendible essentially vertically upwardly such that the height of the distal end is variable, a pulley mounted to the distal end, a first anchor secured to the mast mainframe or telescopic in a fixed position relative to the proximal end. The apparatus includes an essentially vertical track, comprising either the mast mainframe or telescopic, mounted to and extending upwardly from the tractor adjacent the ram, a carriage mounted to the track for essentially vertical movement therealong, the track restraining lateral and pivotal movement of the carriage with respect to the track, a second anchor mounted to the carriage, a compression spring connected to a first of the anchor members and a chain linked at one end to the spring, passing over the pulley and linked at a second end to the second anchor, whereby spring compression increases as carriage load is increased.

These and other objects, advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefor, to the claims herein for interpreting the scope of the invention.

DETAILED DESCRIPTION OF THE INVENTION

Figure 1:
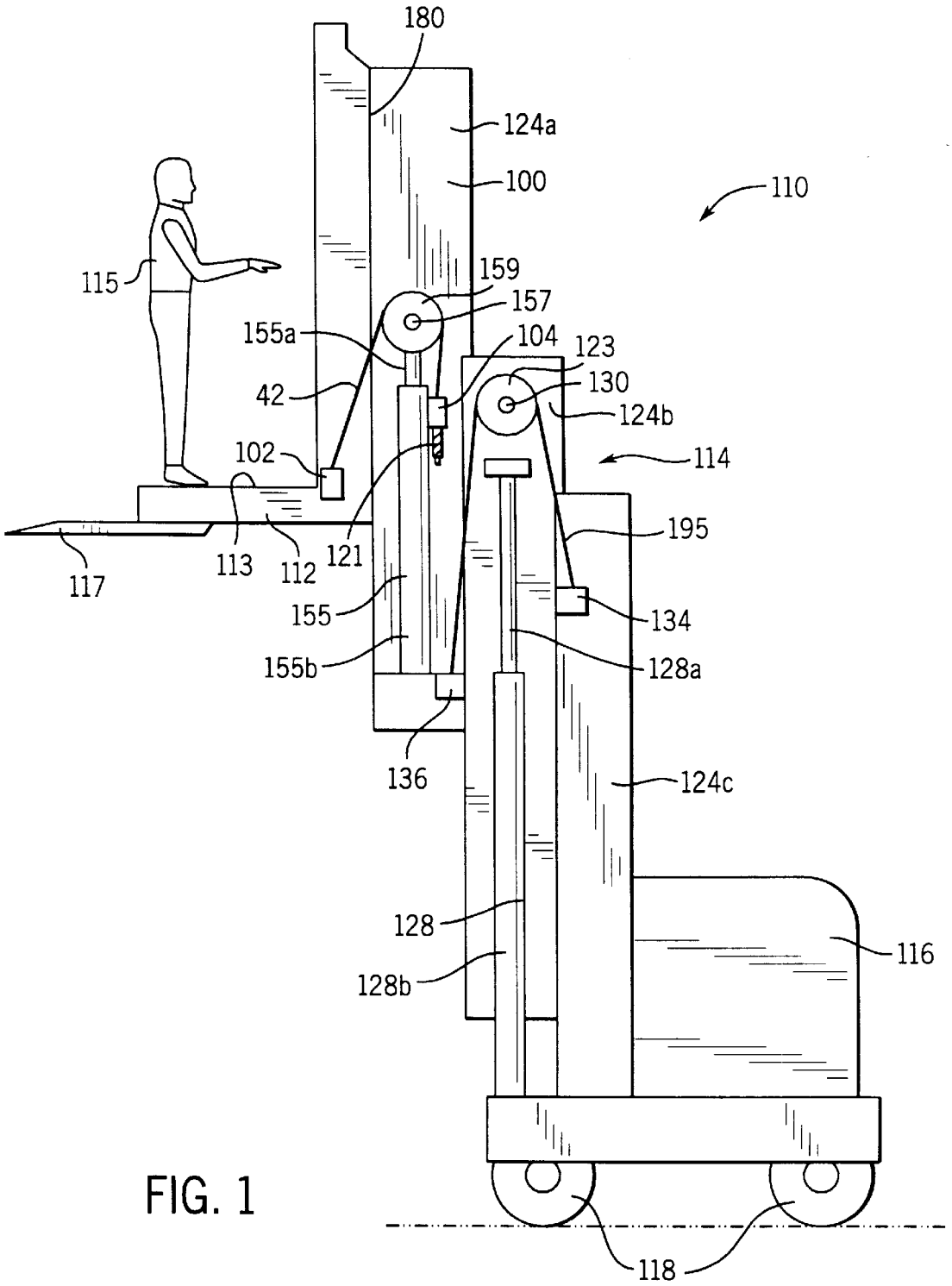
FIG. 1 is a diagrammatic side elevational view of a three-stage lift truck according to the present invention.

Referring to FIG. 1, a typical three-stage lift truck 110 including a carriage 112, a mast 114 and a tractor 116 is shown. For clarity, mast 114 is shown diagrammatically. Tractor 116 includes a plurality of wheels collectively referred to by numeral 118 at least one of which is driven by a traction motor (not illustrated) to facilitate horizontal movement within a warehouse or the like.

Figure 4:
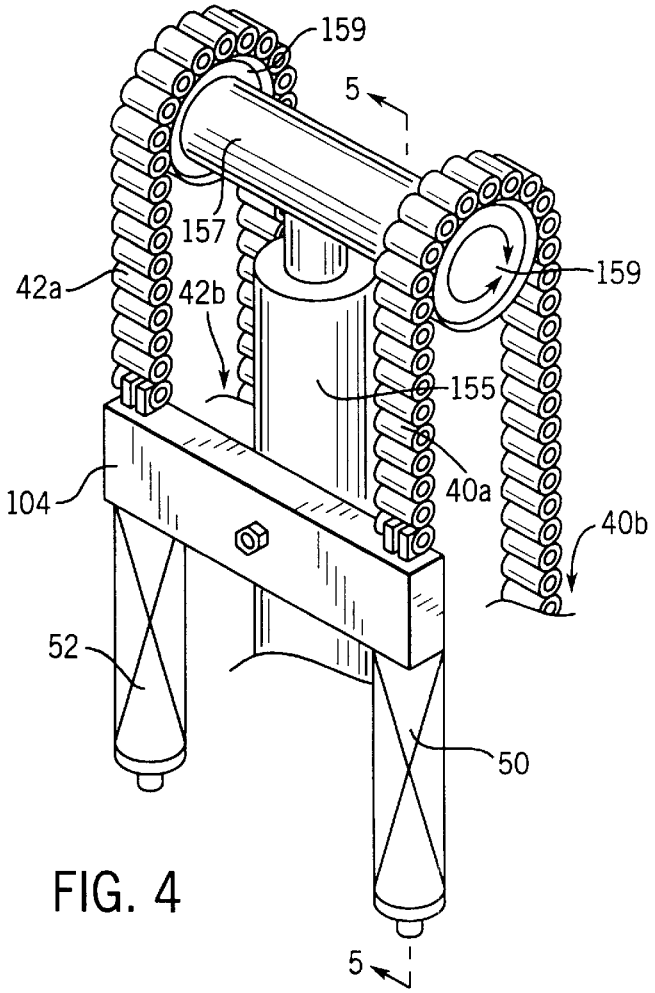
FIG. 4 is a view similar to FIG. 3, albeit of one embodiment of the inventive anchor assembly.

Mast 114 includes a pair of mainframe members 124*c* (only one illustrated), outer and inner pairs of telescopic members 124*b* and 124*a*, respectively, a first ram mechanism 128, a second ram mechanism 155, two pulleys 123 and 159 and two chain assemblies 195 and 42 (also 40 in FIG. 4). Members 124*b* are rigidly connected to one another by horizontal cross-ties (not illustrated) forming a rigid outer telescopic assembly. Similarly, inner members 124*a* as well as mainframe members 124*c* are rigidly connected to one another by horizontal cross-ties (not illustrated) forming an inner rigid assembly and a mainframe rigid assembly.

Figure 2:
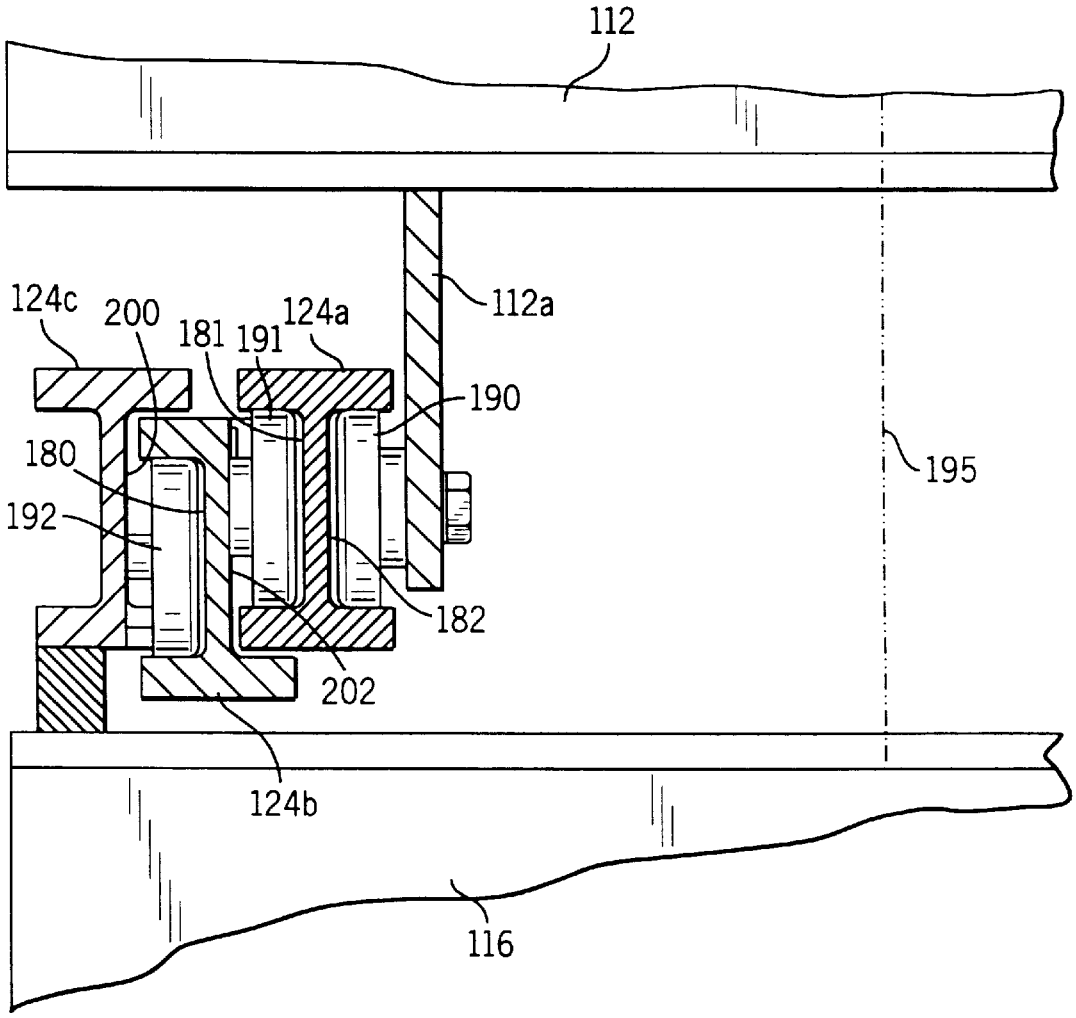
FIG. 2 is cross sectional view of one-half of the three stage mast illustrated in FIG. 1.

Referring also to FIG. 2, mainframe member 124*c* forms an inner track 200, outer telescopic member 124*b* forms an outer track 180 and an inner surface 202 and inner telescopic member 124*a* forms an inner track 182 and an outer track 181. Mainframe member 124*c* is securely fastened to tractor 116. Two or more rollers 192 (only one illustrated) are securely fastened to mainframe member 124*c*. Outer track 180 of member 124*b* is mounted on rollers 192 so as to facilitate rolling engagement of member 124*b* along member 124*c*.

Two or more rollers 191 are also securely fastened to telescopic member 124*b* inner surface 202. Outer track 181 of member 124*a* is mounted on rollers 191 so as to facilitate rolling engagement of member 124*a* along member 124*b*.

Carriage 112 includes a roller mounting bracket 112*a* that has two or more rollers 190 (only one is shown) securely attached thereto. Rollers 190 engage telescopic member 124*a* inner track 182 to facilitate vertical movement thereal-long. Horizontal cross-ties (not illustrated) connect the telescopics 124*a* and 124*b* with mirror image members on the opposite side of a centerline 195, providing a substantially fixed relationship between members 124*a*, 124*b*, and 124*c* in the direction transverse to line 195.

Referring again to FIG. 1, ram 128 includes an upper section 128*a* and a lower section 128*b* which are telescopically arranged. Lower section 128*b* is securely mounted to tractor 116 and upper section 128*a* is securely fastened to telescopic member 124*b*. Pulley 123 is attached to an upper distal end of telescopic 124*b* for rotational engagement by a hub 130. While a single ram and a single pulley are illustrated, a pair of rams and pulleys are used, the two ram/pulley assemblies located on opposite sides of ram telescopic 124*b*. A hydraulic pump and source (not illustrated) are connected to ram 128 and provide hydraulic fluid thereto as commanded by an operator to raise and lower inner telescopic section 128*a* and hub 130 thereabove.

Referring still to FIG. 1 chain 195 passes over pulley 123 and is fastened at one end to anchor 134 which is securely attached to mainframe 124*c* via a bolt, welding or some other means of attachment known in the art. The opposite end of chain 195 is fastened to anchor 136 which is securely attached to the base of telescopic member 124*a*. Thus when rams 128 are extended, telescopic member 124*b* is raised with pulley 123, causing telescopic member 124*a* to raise also, at twice the rate of telescopic member 124*b*.

Referring still to FIG. 1, ram 155 includes upper and lower sections 155*a* and 155*b*, respectively, which are telescopically arranged. The pump and source (not illustrated) which provide fluid to ram 128 also provide hydraulic fluid to ram 155 to raise and lower upper section 155*a* above section 155*b*. The base of ram 155 is securely fastened to the base of telescopic member 124*a*. Pulleys 159 (see FIG. 4) are attached for rotation to an upper distal end of ram 155 via a hub 157. Anchor 104 is securely fastened to a lower section of ram 155.

Referring to FIG. 2, carriage 112 is mounted to outer tracks 182 via brackets 112*a* and rollers 190. Carriage 112 is formed so that it is securely received by tracks 182 for movement only vertically along the tracks 182. In other words, tracks 182 are formed such that carriage 112 will not move laterally on the tracks and will not pivot about a point perpendicular to the length of ram 128.

Referring again to FIG. 1, in the embodiment illustrated, an operator's platform 113 is mounted on carriage 112 and a lift fork assembly 117 is mounted to platform 113. Although not illustrated, platform 113 includes all controls required to operate truck 110 and also includes diagnostic indicators so that an operator 115 can determine operating characteristics.

As best seen in FIG. 4, chains 40 and 42 are fastened at a first end 40*a* and 42*a* to an anchor 104 in a manner described in more detail below. Chains 40 and 42 extend upwardly over pulleys 159 and are securely attached at second ends 40*b* and 42*b* to anchors 102 (see FIG. 1) at the base of carriage 112. Upon operator command, the aforementioned hydraulic pump and supply delivers hydraulic fluid to ram 155 causing the upper section of ram 155 to extend, raising hub 157 and pulleys 159. Since the first end of chains 40 and 42 are attached to the fixed end of ram 155, carriage 112 is raised upwardly with respect to telescopic member 124*a* at twice the rate of extension of ram 155*a*.

Figure 3:
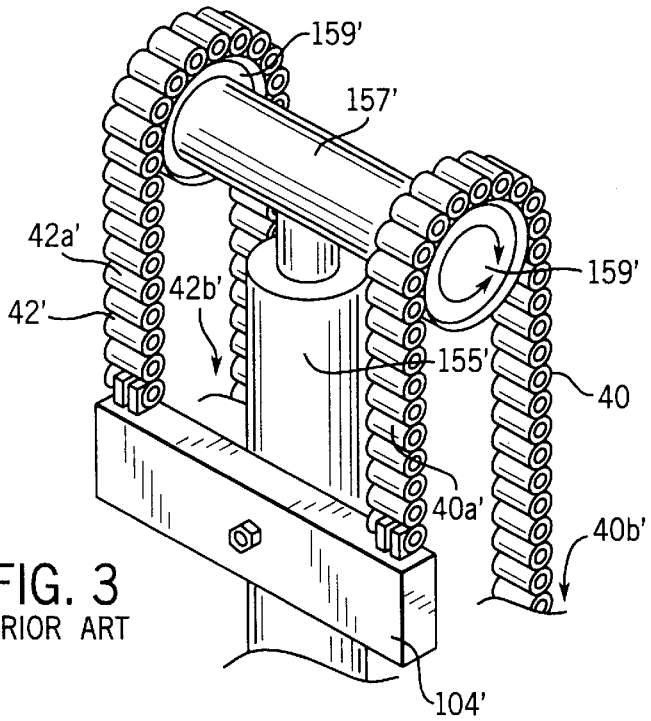
FIG. 3 PRIOR ART
FIG. 3 is an enlarged perspective view of a prior art anchor assembly

Referring now to FIG. 3, a prior art anchoring system is illustrated. In FIG. 3, elements which are similar to elements in FIGS. 1 and 4 are identified by like reference numerals followed by a "'". Thus, chains are referenced by numerals 40 ' and 42 ', etc. In prior art systems, typically chain ends 40*a*' and 42*a*' were rigidly mounted to anchor 104'. Similarly, chain ends 40*b*' and 42*b*' were rigidly mounted (not illustrated). This resulted in transmission of vibrations to station 113 and fork 117 (see FIG. 1).

Referring to FIGS. 1 and 4, according to the present invention, ends 40*a* and 42*a* are not rigidly mounted to anchor 104. Instead, dampeners, preferably in the form of compression springs 50, 52, are provided which connect ends 40*a* and 42*a* to anchor 104. Because springs 50 and 52 are identical and attach to anchor 104 in an identical manner, only spring 50 and its operation will be described here in detail.

Figure 5:
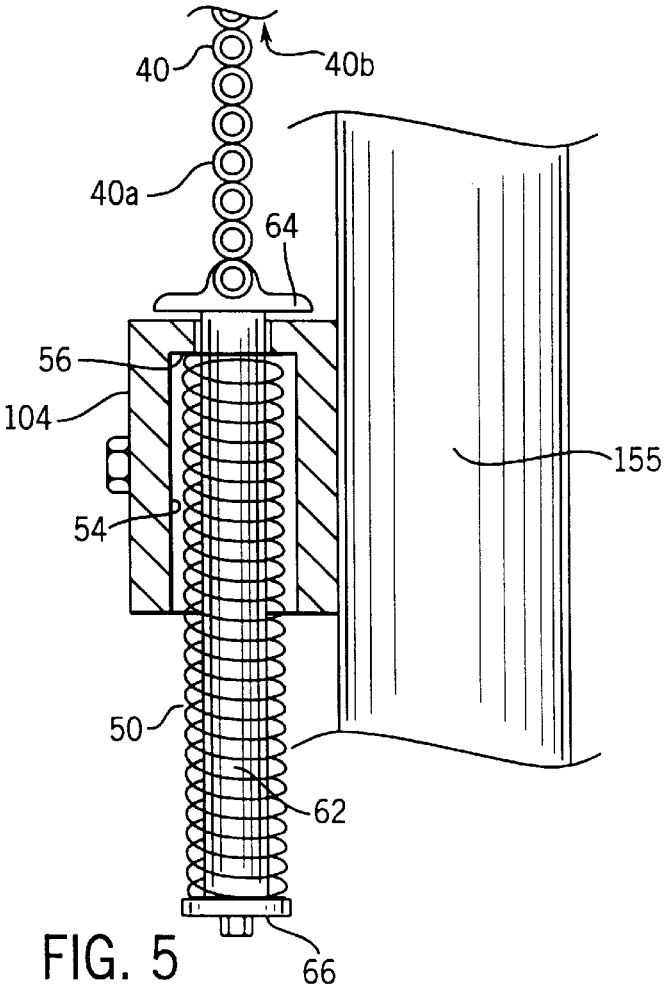
FIG. 5 is a cross-sectional view taken along line 5—5 of FIG. 4.

Referring now to FIG. 5, anchor 104 forms two apertures, the aperture associated with spring 50 illustrated and identified by numeral 54. Aperture 54 has a reduced diameter at an upper end which forms a ledge 56. Spring 50 is a helical cylindrical spring forming an axial channel 58 therethrough. Spring 50 has a diameter less than that of aperture 54 but greater than the diameter of the reduced inner telescopic of aperture 54 which defines ledge 56. Thus, when spring 50 is placed inside aperture 54, one end rests on ledge 56.

An elongated linker in the form of a rod 62 forms first and second radially extending flanges 64, 66, respectively, at opposite ends and has a central section diameter which is less than the diameter of channel 58. When assembled, rod 62 extends through aperture 54 and spring 50 with flange 64 above anchor 104 and flange 66 below spring 50. Chain end 40*a* is attached to rod 62 above flange 64. In practice, flange 66 is a nut and washer.

In operation, when chain 40 is pulled upward, spring 50 is compressed between flange 66 and ledge 56. Referring to FIGS. 1 and 4, when fork 117 is partially loaded and truck 110 is moving along a warehouse floor, when a wheel encounters a floor imperfection, a resulting vibration is transmitted through the truck to springs 50 and 52. Springs 50 and 52 absorb much of the vibration and thereby isolate carriage 112, operator's platform 113 and fork 117.

Importantly, springs 50 and 52 can be selected to be effective at different loads. For example, clearly the total weight of the carriage, including operator and payload, varies from the no load case to the fully loaded case which will typically be around 3000 lb. Selecting springs based on their spring rate can create a low frequency system which has the ability to isolate the carriage for any specific carriage weight, but selected springs may not be effective over an entire payload range (e.g. 0–3000 lb.). For example, to prevent the transmission of vibrations at a given frequency, on one hand, springs selected for optimum performance at no load would have a relatively low spring rate. Unless such springs were abnormally long, these springs would probably collapse to a solid configuration under a full load condition. On the other hand, springs selected to perform with a full 3000 lb. load would be rugged, have a higher spring rate, and would absorb very little vibration unless under full load.

Testing has revealed that heavier payloads provide a degree of natural dampening. Testing has also shown that in the preferred embodiment compression springs of reasonable length can be designed to provide vibration dampening over a payload range of about 1500 lb. Therefore, preferably, the springs used with the present invention are selected such that they provide dampening up to approximately a 1500 lb. payload. Above 1500 lb. the springs may be compressed to solid and therefore may not operate to eliminate carriage vibrations.

In practice the range of payloads over which the invention will be effective is a function of the rated truck capacity and the weight of the carriage. The greater the ratio of carriage weight to capacity, the broader the range of effectiveness. Also, if a given application can tolerate a longer spring, effectiveness over a greater payload range will be possible.

In addition, springs 50, 52 can be selected so that they eliminate vibrations at certain problematic frequencies. Field tests have revealed that a particularly problematic vibration frequency is between 3 and 8 Hz and is, in particular 5 Hz. Thus by selecting a spring which has a natural oscillating frequency less than the troublesome frequency, the spring will absorb rather than transmit vibrations at the troublesome frequency and thereabove. In the present case, because 5 Hz is the troublesome frequency, springs 50, 52 should have a natural frequency of less than 5 Hz and preferably less than about 4 Hz.

An appropriate spring rate can be calculated using the well known relationship between natural frequency, mass and spring rate shown below.

$$f_n = \frac{1}{2\pi} \cdot \sqrt{\frac{386k}{W_{MIN}}} \qquad \text{Eq. 1}$$

where $f_n$ is the desired natural frequency (Hz), $W_{MIN}$ is the weight of the unladen carriage (lb.), and k is the required spring rate (lb./in.). The constants $2\pi$ and 386 are unit correction factors.

It should be understood that the apparatuses described above are only exemplary and do not limit the scope of the invention, and that various modifications could be made by those skilled in the art that would fall under the scope of the invention. For example, while the invention is described as having chains attached to the anchor 104 via springs, clearly the springs could be provided at the other ends of the chains connected to anchor 102, or springs could be provided at both ends of the chains 40, 42 to provide additional dampening.

Further, the isolation described herein could be employed at anchors 134 or 136 as seen in FIG. 1. Since the weight of the telescopic would be added to the payload weight, carriage, and operator weights, the required spring stiffness would be greater if the isolation were provided at these locations.

Figure 6:
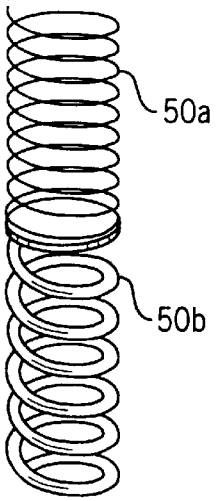
FIG. 6 is a perspective view of a spring used in the present invention.

In addition, two separate springs could be provided on each chain, one spring which reduces or eliminates vibrations at no load or reduced load and another spring which reduces or eliminates vibrations at full or near full load. To this end, referring to FIGS. 5 and 6, springs 50 (and 52 in FIG. 4) would be replaced with two springs 50*a* and 50*b* wherein spring 50*a* is chosen to eliminate vibrations when the load is between no load and 1500 pounds and spring 50*b* is chosen to eliminate vibrations when the load is above 1500 pounds when spring 50*a* is completely or nearly completely compressed. This arrangement may be particularly useful when a single spring would be too long for practical implementation.

Figure 7:
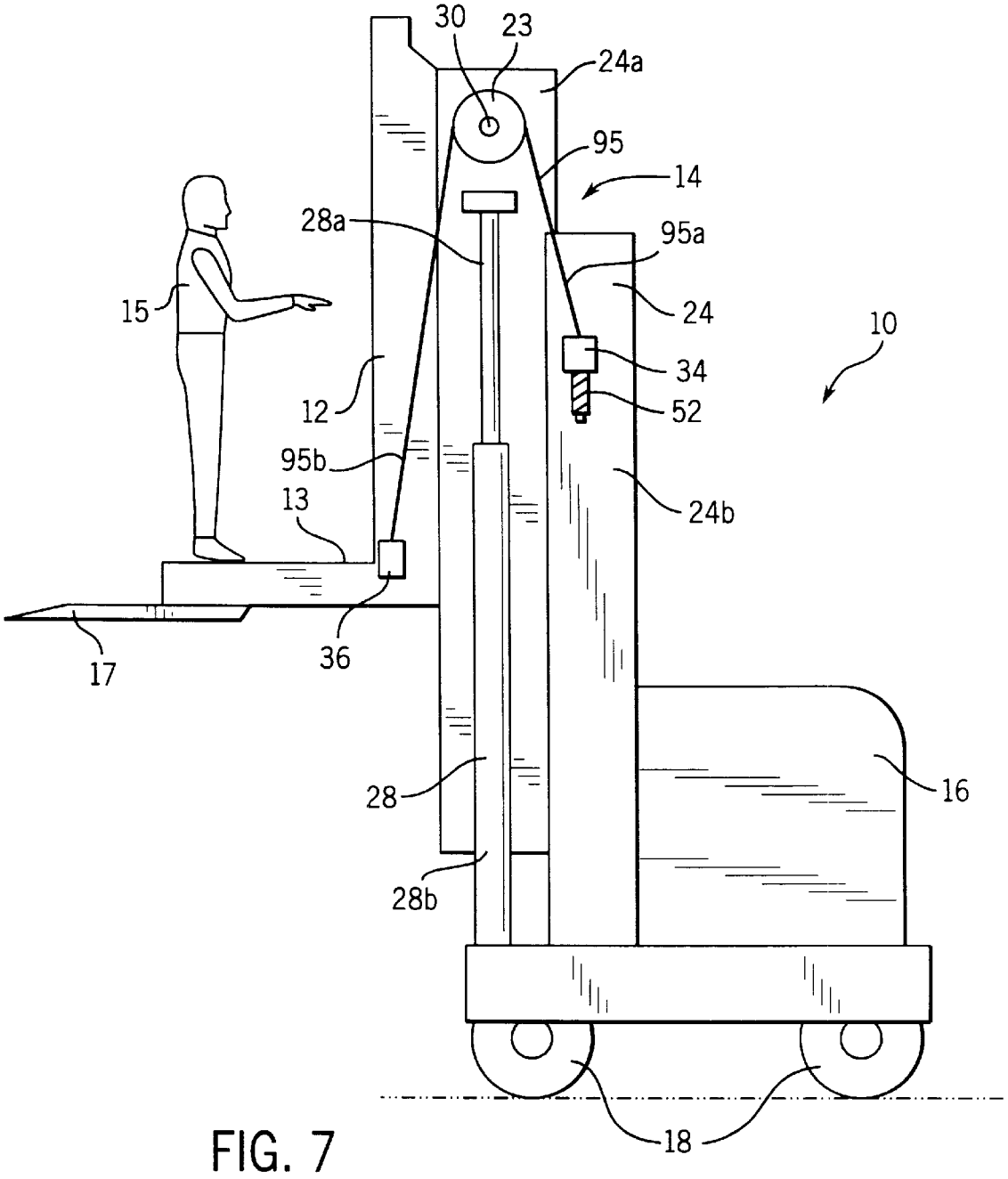
FIG. 7 is a side elevational view of a two-stage lift truck according to the present invention.

Referring now to FIG. 7, an alternate embodiment for a two-stage mast is illustrated. In this case, tractor 16 and carriage 12 are substantially the same as tractor 116 and carriage 112. Therefore, tractor 16 and carriage 12 will not be explained here in detail. However, mast 14 differs from mast 114 in that it has one less telescopic stage. In this embodiment, a first end 95*a* of chain 95 is attached to mainframe 24 at anchor 34, passes over hub 30 and pulley 23 and is attached at a second end 95*b* to carriage 12 at anchor 36. The extension of ram 28 directly raises telescopic member 24*a* causing carriage 12 to elevate at twice the rate of section 28*a*. Preferably, chain 95 comprises a pair of chains and ram 28 comprises a pair of rams, each acting in concert with the other to raise carriage 12. Accordingly, there are preferably a pair of anchors 36 and a pair of anchors 34. The first end of chain 95 is attached to anchor 34 in substantially the same way as is shown in FIG. 5 with anchor 104 replaced by anchor 34 and ram 155 replaced by mainframe 24.

Of course the inventive suspension mechanism can be employed at anchor 36 instead of anchor 34 (see FIG. 7) or at both anchors 34 and 36. As with three-stage masts, two separate springs of different spring rates can be used on each chain to address different load ranges.

Thus the inventive suspension mechanism can be used with two-stage mast systems as well as three-stage. By simple extrapolation, it is clear that the inventive suspension mechanism can be applied to masts that employ no telescopics as well as those that use more than two telescopics.

Furthermore, while the invention is described as one where the tracks restrain lateral movement of the platform, clearly other means could be provided for this purpose or, the track in conjunction with the other means could achieve this result ( i.e. the track and ram together).

The preceding discussions describes a tractor with a plurality of wheels. Of course alternate configurations are possible whereby some of the wheels for horizontal transport are attached to the mast mainframe which is in turn secured to the tractor. The actual construction for horizontal transport is not believed to be important to the present invention.

To apprise the public of the scope of this invention, I make the following claims:

I claim:

1. An apparatus for isolating a lift carriage on a truck, the truck including a tractor supported by a plurality of wheels, the apparatus comprising:

an essentially vertical supporter mounted to and extending upwardly from the tractor and forming an essentially vertical track, the supporter and tractor being support components;

a ram having proximal and distal ends and mounted to one of the support components at the proximal end so as to be adjacent at least a portion of the supporter, the ram extendable essentially vertically upwardly such that a distal end height is variable, the tractor, ram and supporter being anchor components;

a pulley mounted in a fixed position with respect to the distal end such that a pulley height varies as distal end height varies;

a carriage mounted to the track for essentially vertical movement therealong, the track restraining lateral movement of the lift member;

a first anchorer secured to one of the anchor components in a fixed position relative to the proximal end;

a second anchorer secured to the carriage, the first and second anchorers being anchor members;

a dampener linked to a first of the anchor members; and a strand linked at a first end to the dampener, passing over the pulley and linked at a second end to a second of the anchor members.

2. The apparatus of claim 1 wherein the dampener is a spring.

3. The apparatus of claim 2 wherein the spring is at least partially expanded throughout at least a range of payloads.

4. The apparatus of claim 2 wherein the strand is a chain.

5. The apparatus of claim 4 wherein a lift fork is mounted to the carriage.

6. The apparatus of claim 4 wherein the carriage is an operator's platform.

7. The apparatus of claim 6 wherein a lift fork is mounted to the operator's platform.

8. The apparatus of claim 7 wherein the spring is a compression spring having first and second ends.

9. The apparatus of claim 4 wherein there are two chains and two pulleys, one chain positioned on either side of the vertical supporter.

10. An apparatus for isolating a lift carriage on a truck, the truck including a tractor supported by a plurality of wheels, the apparatus comprising:

an essentially vertical supporter mounted to and extending upwardly from the tractor and forming an essentially vertical track, the supporter and tractor being support components;

a ram having proximal and distal ends and mounted to one of the support components at the proximal end so as to be adjacent at least a portion of the supporter, the ram extendable essentially vertically upwardly such that a distal end height is variable, the tractor, ram and supporter being anchor components;

a pulley mounted in a fixed position with respect to the distal end such that a pulley height varies as distal end height varies;

a carriage mounted to the track for essentially vertical movement therealong, the track restraining lateral movement of the lift member;

a first anchorer secured to one of the anchor components in a fixed position relative to the proximal end;

a second anchorer secured to the carriage, the first and second anchorers being anchor members;

a spring linked to a first of the anchor members, the spring at least partially expanded throughout at least a range of payloads wherein the range of payloads is between no load and at least one-fourth of the vehicle rated capacity; and a strand linked at a first end to the dampener, passing over the pulley and linked at a second end to a second of the anchor members.

11. The apparatus of claim 10 wherein the range of payloads is between no load and at least one half the vehicle rated capacity.

12. An apparatus for isolating a lift carriage on a truck, the truck including a tractor supported by a plurality of wheels, the apparatus comprising:

an essentially vertical supporter mounted to and extending upwardly from the tractor and forming an essentially vertical track, the supporter and tractor being support components;

a ram having proximal and distal ends and mounted to one of the support components at the proximal end so as to be adjacent at least a portion of the supporter, the ram extendable essentially vertically upwardly such that a distal end height is variable, the tractor, ram and supporter being anchor components;

a pulley mounted in a fixed position with respect to the distal end such that a pulley height varies as distal end height varies;

an operator's platform mounted to the track for essentially vertical movement therealong, the track restraining lateral movement of the lift member, a lift fork mounted to the operator's platform;

a first anchorer secured to one of the anchor components in a fixed position relative to the proximal end;

a second anchorer secured to the operator's platform, the first and second anchorers being anchor members;

a compression spring linked to a first of the anchor members, the spring having first and second ends; and a chain linked at a first end to the spring, passing over the pulley and linked at a second end to a second of the anchor members;

wherein the assembly further includes a linker connecting the chain to the spring, the first anchor member forms an aperture, the linker passes through the aperture and the compression spring and is connected to the second end such that the spring is at least partially compressed between the linker and the first anchor member.

13. The apparatus of claim 12 wherein the first anchor member is the first anchor.

14. The apparatus of claim 12 wherein the spring includes first and second compression springs and the first and second springs become completely compressed at different carriage weights with the weight required to completely compress the second spring being greater than the weight required to completely compress the first spring.

15. The apparatus of claim 14 wherein the truck is designed to carry a maximum carriage weight and the weight required to completely compress the second spring is approximately the maximum carriage weight.

16. The apparatus of claim 15 wherein the weight required to completely compress the first spring is essentially half the maximum carriage weight.

17. An apparatus for isolating a lift carriage on a truck, the truck including a tractor supported by a plurality of wheels, the apparatus comprising:

an essentially vertical supporter mounted to and extending upwardly from the tractor and forming an essentially vertical track, the supporter and tractor being support components wherein the supporter includes one mainframe and at least one essentially vertical telescopic, the mainframe fixedly mounted to the tractor, the telescopic received by the mainframe for vertical movement therealong and the track formed by the telescopic;

a ram having proximal and distal ends and mounted to one of the support components at the proximal end so as to be adjacent at least a portion of the supporter, the ram extendable essentially vertically upwardly such that a distal end height is variable, the tractor, ram and supporter being anchor components;

a pulley mounted in a fixed position with respect to the distal end such that a pulley height varies as distal end height varies;

a carriage mounted to the track for essentially vertical movement therealong, the track restraining lateral movement of the lift member;

a first anchorer secured to one of the anchor components in a fixed position relative to the proximal end;

a second anchorer secured to the carriage, the first and second anchorers being anchor members;

a dampener linked to a first of the anchor members; and a strand linked at a first end to the dampener, passing over the pulley and linked at a second end to a second of the anchor members.

18. The apparatus of claim 17 wherein the first anchor member is secured to the mainframe, the proximal end is secured to the tractor, the pulley is secured to an upper end of the telescopic and the distal end is secured to the telescopic below the pulley.

19. The apparatus of claim 17 wherein the telescopic includes at least an outer and an inner telescopic, the inner telescopic received by the outer telescopic for vertical movement therealong and the outer telescopic received by the mainframe for vertical movement therealong, the inner telescopic forming the track.

20. The apparatus of claim 19 wherein the first anchor member is secured to the proximal end, the proximal end is secured to a lower end of the inner telescopic and the pulley is secured to the distal end.

21. The apparatus of claim 20 wherein the ram is a first ram, the pulley is a first pulley, the strand is a first strand and the apparatus further includes a second ram, a second pulley and a second strand, the second ram including upper and lower ends, secured to the tractor at the lower end and is extendable essentially vertically upwardly such that the height of the upper end is variable, the second pulley secured to the outer telescopic, the second ram upper end secured to the outer telescopic in a fixed position relative to the pulley such that when an upper end height is varied, the second pulley height is varied, the second strand secured at a first end to the mainframe, extending over the second pulley and secured at a second end to the inner telescopic.

22. An apparatus for isolating a lift carriage on a truck, the truck including a tractor supported by a plurality of wheels, the apparatus comprising:

an essentially vertical supporter mounted to and extending upwardly from the tractor and forming an essentially vertical track, the supporter and tractor being support components;

a ram having proximal and distal ends and mounted to one of the support components at the proximal end so as to be adjacent at least a portion of the supporter, the ram extendable essentially vertically upwardly such that a distal end height is variable, the tractor, ram and supporter being anchor components;

a pulley mounted in a fixed position with respect to the distal end such that a pulley height varies as distal end height varies;

a carriage mounted to the track for essentially vertical movement therealong, the track restraining lateral movement of the lift member;

a first anchorer secured to one of the anchor components in a fixed position relative to the proximal end;

a second anchorer secured to the carriage, the first and second anchorers being anchor members;

a spring linked to a first of the anchor members wherein the spring is chosen to eliminate frequency vibrations between 3 and 8 hertz; and a strand linked at a first end to the spring, passing over the pulley and linked at a second end to a second of the anchor members.

23. The apparatus of claim 22 wherein the spring is chosen to eliminate frequency vibrations of approximately 5 hertz.

24. A suspension apparatus to be used with a material handling vehicle, the vehicle including a tractor supported by a plurality of wheels, a ram having proximal and distal ends, supported in a vertical orientation and extendable essentially vertically upwardly such that a distal end height is variable, a pulley mounted in a fixed position with respect to the distal end such that a pulley height varies as distal end height varies, the apparatus comprising:

an essentially vertical supporter mounted to and extending upwardly from the tractor and forming an essentially vertical track, the supporter and tractor being support components, the ram secured to one of the support components, the ram, supporter and tractor being anchor components;

a carriage mounted to the track for essentially vertical movement therealong, the track restraining lateral movement of the carriage;

a first anchorer secured to one of the anchor components in a fixed position relative to the proximal end;

a second anchorer mounted to the carriage;

a compression spring connected to the first anchorer; and a chain linked at one end to the spring, passing over the pulley and linked at a second end to the second anchorer;

whereby, spring compression increases as a carriage load is increased.

25. The apparatus of claim 24 wherein there are two chains and two pulleys, one chain positioned on either side of the supporter.

26. The apparatus of claim 25 wherein the carriage is an operator's platform.

27. A suspension apparatus to be used with a material handling vehicle, the vehicle including a tractor supported by a plurality of wheels, a ram having proximal and distal ends, supported in a vertical orientation and extendable essentially vertically upwardly such that a distal end height is variable, a pulley mounted in a fixed position with respect to the distal end such that a pulley height varies as distal end height varies, the apparatus comprising:

an essentially vertical supporter mounted to and extending upwardly from the tractor and forming an essentially vertical track, the supporter and tractor being support components, the ram secured to one of the support components, the ram, supporter and tractor being anchor components; wherein the supporter includes one mainframe and at least one essentially vertical telescopic, the mainframe fixedly mounted to the tractor, the telescopic received by the mainframe for vertical movement therealong and the track formed by the telescopic a carriage mounted to the track for essentially vertical movement therealong, the track restraining lateral movement of the carriage;

a first anchorer secured to one of the anchor components in a fixed position relative to the proximal end;

a second anchorer mounted to the carriage;

a compression spring connected to the first anchorer; and a chain linked at one end to the spring, passing over the pulley and linked at a second end to the second anchorer;

whereby, spring compression increases as a carriage load is increased.

28. The apparatus of claim 27 wherein the first anchorer is secured to the mainframe, the proximal end is secured to the tractor, the pulley is secured to an upper end of the telescopic and the distal end is secured to the telescopic below the pulley.

29. The apparatus of claim 27 wherein the telescopic includes at least an outer and an inner telescopic, the inner telescopic received by the outer telescopic for vertical movement therealong and the outer telescopic received by the mainframe for vertical movement therealong, the inner telescopic forming the track.

30. The apparatus of claim 29 wherein the first anchorer is secured to the proximal end, the proximal end is secured to a lower end of the inner telescopic and the pulley is secured to the distal end.

31. The apparatus of claim 30 wherein the ram is a first ram, the pulley is a first pulley, the strand is a first strand and the apparatus further includes a second ram, a second pulley and a second strand, the second ram including upper and lower ends, secured to the tractor at the lower end and is extendable essentially vertically upwardly such that the height of the upper end is variable, the second pulley secured to the outer telescopic, the second ram upper end secured to the outer telescopic in a fixed position relative to the pulley such that when an upper end height is varied, the second pulley height is varied, the second strand secured at a first end to the mainframe, extending over the second pulley and secured at a second end to the inner telescopic.

32. An apparatus for isolating a lift carriage on a truck, the truck including a tractor supported by a plurality of wheels, the apparatus comprising:

an essentially vertical supporter mounted to and extending upwardly from the tractor and forming an essentially vertical track, the supporter and tractor being support components;

a ram having proximal and distal ends and mounted to one of the support components at the proximal end so as to be adjacent at least a portion of the supporter, the ram extendable essentially vertically upwardly such that a distal end height is variable, the tractor, ram and supporter being anchor components;

a pulley mounted in a fixed position with respect to the distal end such that a pulley height varies as distal end height varies;

a carriage mounted to the track for essentially vertical movement therealong, the track restraining lateral movement of the lift member;

a first anchorer secured to one of the anchor components in a fixed position relative to the proximal end;

a second anchorer secured to the carriage, the first and second anchorers being anchor members;

a spring linked to a first of the anchor members, the spring including first and second compression springs and the first and second springs becoming completely compress at different carriage weights with the weight required to completely compress the second spring being greater than the weight required to completely compress first spring; and a strand linked at a first end to the dampener, passing over the pulley and linked at a second end to a second of the anchor members.

* * * * *